US010154939B2

(12) United States Patent
Kobayashi

(10) Patent No.: US 10,154,939 B2
(45) Date of Patent: Dec. 18, 2018

(54) LIVING BODY STIMULATOR

(71) Applicant: TECHNO LINK CO., LTD., Niigata-shi, Niigata (JP)

(72) Inventor: Tatsuyuki Kobayashi, Niigata (JP)

(73) Assignee: TECHNO LINK CO., LTD., Niigata (JP)

( * ) Notice: Subject to any disclaimer, the term of this patent is extended or adjusted under 35 U.S.C. 154(b) by 596 days.

(21) Appl. No.: 14/857,060

(22) Filed: Sep. 17, 2015

(65) Prior Publication Data

US 2016/0128895 A1 May 12, 2016

(30) Foreign Application Priority Data

Nov. 11, 2014 (JP) ..... 2014-228796

(51) Int. Cl.
*A61H 9/00* (2006.01)

(52) U.S. Cl.
CPC ... *A61H 9/0078* (2013.01); *A61H 2201/0107* (2013.01); *A61H 2201/164* (2013.01); *A61H 2201/165* (2013.01); *A61H 2201/5002* (2013.01); *A61H 2201/5071* (2013.01)

(58) Field of Classification Search
CPC ..... A61H 9/0078; A61H 2201/5002; A61H 2201/165; A61H 2201/0107; A61H 2201/164; A61H 2201/5071
See application file for complete search history.

(56) References Cited

U.S. PATENT DOCUMENTS 4,928,674 A 5/1990 Halperin et al.
5,588,955 A 12/1996 Johnson et al.
6,589,267 B1 7/2003 Hui
2001/0000262 A1* 4/2001 McEwen ..... A61H 9/0078 601/11
2002/0099409 A1* 7/2002 Hui ..... A61G 7/05776 606/201
2002/0103454 A1 8/2002 Sackner et al.
2005/0187500 A1* 8/2005 Perry ..... A61H 9/0078 601/152

(Continued)

FOREIGN PATENT DOCUMENTS

DE 102007044188 3/2009
JP S55-30127 U 2/1980
JP 2004-261592 A 9/2004

(Continued)

OTHER PUBLICATIONS

European Search Report completed Mar. 9, 2016, in corresponding EP Application No. 15020147.

*Primary Examiner* — Quang D Thanh
(74) *Attorney, Agent, or Firm* — Fox Rothschild LLP

(57) ABSTRACT

Provided is a living body stimulator capable of not only realizing a low power consumption and a light weight, but also improving the degree of freedom of an outer shape thereof. Each of airbags (3-1) to (3-3) is individually provided with one of air pumps (1-1) to (1-3) and one of air tanks (2-1) to (2-3). As for each of pressurization units (41-1) to (41-3), a pressurized air is supplied from one air pump (1-1) to one airbag (3-1) through one air tank (2-1). A control unit (51) is configured to individually control each of the pressurization units (41-1) to (41-3). Therefore, it is possible to downsize the air pumps (1-1) to (1-3) and air tanks (2-1) to (2-3).

10 Claims, 6 Drawing Sheets

(56) References Cited

U.S. PATENT DOCUMENTS

| | | | | |
|---|---|---|---|---|
| 2006/0004245 | A1* | 1/2006 | Pickett | A61H 9/0078 600/16 |
| 2011/0313235 | A1 | 12/2011 | Gleim | |

FOREIGN PATENT DOCUMENTS

| | | | |
|---|---|---|---|
| JP | 2005-261817 | | 9/2005 |
| JP | 2008-200224 | A | 9/2008 |
| JP | 2013-66681 | A | 4/2013 |
| WO | 0243645 | A2 | 6/2002 |
| WO | 2011/108485 | A1 | 9/2011 |

* cited by examiner

LIVING BODY STIMULATOR

CROSS REFERENCE TO RELATED APPLICATIONS

This US Application claims priority to Japanese Application No.: 2014-228796 filed Nov. 11, 2014, entitled "LIVING BODY STIMULATOR" the entirety of which is incorporated herein by reference.

BACKGROUND OF THE INVENTION

Field of the Invention

The present invention relates to a living body stimulator such as an ECP (external counter pulsation) device for curing and treating a living body by supplying a fluid pressurized by a pump to a bag worn by the living body.

Background Art

EPC devices as living body stimulators have been mainly used to treat heart diseases. However, in recent years, such EPC devices have also been used as auxiliary devices for performing beauty and sports treatments. Each of JP-A-2004-261592, JP-A-2008-200224 and Japanese Unexamined Patent Application Publication (Translation of PCT Application) No. 2004-523260 discloses a detailed structure of such EPC device.

During systole, the heart of a human body as a living body pumps blood to each section of the human body. In contrast, in diastole, the blood returns to the heart largely owing to the muscle movements of the human body. Particularly, the muscles of the lower limbs that are distant from the heart are often referred to as the second heart. That is, these muscles play a significant role. An EPC device is therefore a device used to return the blood to the heart by pressurizing and thus stimulating the lower limbs and the lumbar area during diastole as a passive state of the heart. Specifically, this is carried out by supplying an air pressurized by an air pump to an airbag(s) wound around each lower limb or the lumbar area.

Each of the EPC devices disclosed in JP-A-2004-261592, JP-A-2008-200224 and Japanese Unexamined Patent Application Publication (Translation of PCT Application) No. 2004-523260 is configured in a manner such that the pressurized air is supplied from a single and shared air pump to multiple airbags through an air tank. FIG. 10 is a diagram schematically showing this configuration.

In FIG. 10, a conventional ECP device 100 includes a single air pump 1 for generating a pressurized air; an air tank 2 for retaining the pressurized air from the air pump 1; and at least one pressurization airbag 3 that is to be attached to a treatment area of a human body. In general, a plurality of such airbags 3 are connected to a single air supply circuit 5 having the single air pump 1 and the single air tank 2. As shown in FIG. 10, the conventional ECP device 100 employs three airbags 3-1 to 3-3 that are capable of being individually attached to the upper part of the thigh, the lower part of the thigh and the calf part of a human body.

Here, the outlet of the air pump 1 and the inlet of the air tank 2 are communicated with each other through a first flow passage 11 as a part of the air supply circuit 5. Further, the air tank 2 is provided with the same number of outlets as the airbags 3-1 to 3-3. Particularly, these outlets of the air tank 2 are individually communicated with the airbags 3-1 to 3-3 through second flow passages 12-1 to 12-3. Open-air passages 13-1 to 13-3 whose front ends are open to the atmosphere, are individually communicated with the midway sections of the second flow passages 12-1 to 12-3. In addition, injection magnetic valves 15-1 to 15-3 are individually connected to the sections of the second flow passages 12-1 to 12-3 that extend from the outlets of the air tank 2 to the base ends of the open-air passages 13-1 to 13-3. Other than the injection magnetic valves 15-1 to 15-3, discharge magnetic valves 16-1 to 16-3 are individually connected to the open-air passages 13-1 to 13-3.

Attached to the air tank 2 are a pressure sensor 21 for sensing the pressure inside the air tank 2; and a leakage valve 22 for discharging to the atmosphere a small amount of the pressurized air from the air tank 2. Both the pressure sensor 21 and the leakage valve 22 serve to control the speed of a motor as a driving source of the air pump 1.

SUMMARY OF THE INVENTION

With regard to the aforementioned configuration, the conventional ECP device 100 requires the single and large-size air pump 1 to supply the pressurized air therefrom to the airbags 3-1 to 3-3, thus inevitably consuming a large amount of the pressurized air. Therefore, a three-phase AC power source of 220 V to 240 V is, for example, required to drive the air pump 1, which makes it troublesome to use the ECP device 100. FIG. 11 is a diagram showing the detailed structure of the conventional air supply circuit 5. As shown in FIG. 11, there is employed the air pump 1 with a power frequency synchronous motor M built therein. Further, there is required a power unit 24 internally equipped with an inverter capable of changing the frequency of the AC power supplied to the motor M. Here, the aforementioned power source serves as an input to the power unit 24, and the power unit 24 is needed to control the revolutions of the air pump 1 which represent the performance thereof.

In fact, the aforementioned power source is hardly available at a location where the ECP device 100 is generally installed. That is, there additionally occur a cost of electric construction, a construction time and a power consumption of the power source that are associated with the installation of the device. Moreover, it is practically not possible to move the ECP device 100 to a different location once installed. In view of these concerns, there has been anticipated a power saving ECP device that does not require an additional power source, a special large-size air pump 1 and a special large-size air tank 2; but can be operated with a limited power from an existing outlet (e.g. single-phase AC of about 100 V to 120 V, 1.5 kW).

It is an object of the present invention to provide a living body stimulator requiring no special large-size pump or tank such that not only the power and weight of the device can be saved, but the degree of freedom of an outer shape thereof can also be improved.

In order to obtain such power-saving living body stimulator, a configuration capable of functioning with a small pump(s) is required instead of using a large pump consuming most power. The living body stimulator of the present invention includes: a plurality of pressurization units; and a control unit for individually and independently controlling an operation of each of the pressurization units, wherein each of the pressurization units has: a pump for generating a pressurized fluid; a tank for retaining the pressurized fluid from the pump; and a pressurization bag worn by a living body, the pressurization bag pressurizing and thus stimulating the living body as the pressurized fluid is supplied from the tank to the pressurization bag. That is, the living body stimulator of the invention has multiple pumps, tanks and bags; and each pressurization unit is configured in a manner such that the pump and the tank are provided for each bag.

According to the invention as set forth in the first aspect, the pump and the tank are provided for each bag such that each pressurization unit allows the pressurized fluid to be supplied to a single bag from a single pump through a single tank. Further, the control unit is used to individually and independently control the multiple pressurization units. In this way, the sizes of the pumps and tanks that are both dispersedly and individually installed in the pressurization units can be reduced. Thus, unlike the conventional devices, special large-size pump and tank are not necessarily required, thereby not only saving the power and weight of the living body stimulator, but also improving the degree of freedom of the outer shape of the device.

According to the invention as set forth in the second aspect, although the pressure of each tank decreases every time the injection valve is opened to communicate the tank and the bag with each other, the pressure of the bag is not regulated by sensing the pressure of the tank, but is individually regulated by sensing the pressure of the outlet side of the injection valve that serves as a fluid outlet of the device, with respect to each of the pressurization units. Therefore, the fluid volume on the air supply circuit side composed of the pump and the tank can be reduced, thus shortening a pressure restoration time of each tank.

According to the invention as set forth in the third aspect, when the bag pressure sensed by the bag pressure sensing unit has reached the preset upper limit value, the bag will be disconnected from the tank, thereby allowing the bag to maintain its pressure and requiring the tank pressure to only remain in a given range, thus requiring no fluid leakage circuit having a leakage valve to adjust the tank pressure as is conventionally required. Further, the required amount of the pressurized fluid in the tank can be reduced, thus making it possible to downsize the pump and achieving a low power consumption.

According to the invention as set forth in the fourth aspect, pressure control is individually performed on each treatment area wearing the bag. That is, by individually setting the bag pressure with respect to each pressurization unit, a pressure suitable for each treatment area can be individually applied from each bag. Therefore, particular requests of each patient can be met, thus making it possible to alleviate the pain of the patient.

According to the invention as set forth in the fifth aspect, the pressure of the bag is controlled by opening and closing the injection valve as a magnetic valve. Thus, by setting the bag pressure every time the pressurized fluid is injected into the bag, the pressure of the bag can be changed in a short period of time.

According to the invention as set forth in the sixth aspect, the bag pressure is not controlled through a tank-pressure sensing unit as is used conventionally, but is precisely controlled by sensing the pressure of the outlet side of the magnetic valve that serves as the fluid outlet of the device. For this reason, the pressure of the tank is not significant. Thus, the operation of each pump may be controlled in a less sophisticated manner. That is, various kinds of pumps susceptible to load changes can be employed, without having to purposefully use a high-powered rotary pump.

According to the invention as set forth in the seventh aspect, the multiple delay times that occur when the injection valve is switched from the open state to the closed state are read, and the electric conduction-switching timing for closing the injection valve is adjusted based on such delay times. In this way, it is possible to precisely control the pressure of the bag at the time of injection, with respect to each pressurization unit.

According to the invention as set forth in the eighth aspect, by controlling the bag pressure even at the time of discharge such that discharge finishes with a small amount of the pressurized fluid remaining in the bag, the bag is allowed to undergo deformation in a less significant manner, thus reducing the amount of fluid consumption for the next injection. Further, the load of the pump is light in this invention, thus resulting in a low power consumption of the pump.

According to the invention as set forth in the ninth aspect, the multiple delay times that occur when the discharge valve is switched from the open state to the closed state are read, and the electric conduction-switching timing for closing the discharge valve is adjusted based on such delay times. In this way, it is possible to precisely control the pressure of the bag at the time of discharge, with respect to each pressurization unit.

According to the invention as set forth in the tenth aspect, the pump control devices serve to control the phase of an AC power before outputting the same to the diaphragm pumps, thereby allowing the performances of such pumps to be easily changed. Further, as for the circuit that is installed in each pump control device and used to perform phase control, a solid state relay or the like may be used to configure such circuit in a simple manner such that the configuration of this circuit can be significantly simplified. Moreover, since diaphragm pumps are widely available in the market, not only the delivery period of the device can be shortened, but the cost thereof can also be reduced.

According to the invention as set forth in the eleventh aspect, since the tank is not regarded as the (simple) container defined by a Japanese domestic law, it can be self-manufactured freely in terms of the shape thereof, thus making it possible to significantly reduce the space and cost of the living body stimulator.

DETAILED DESCRIPTION OF THE INVENTION

A preferred embodiment of a living body stimulator of the present invention is described hereunder with reference to the accompanying drawings.

Figure 1:
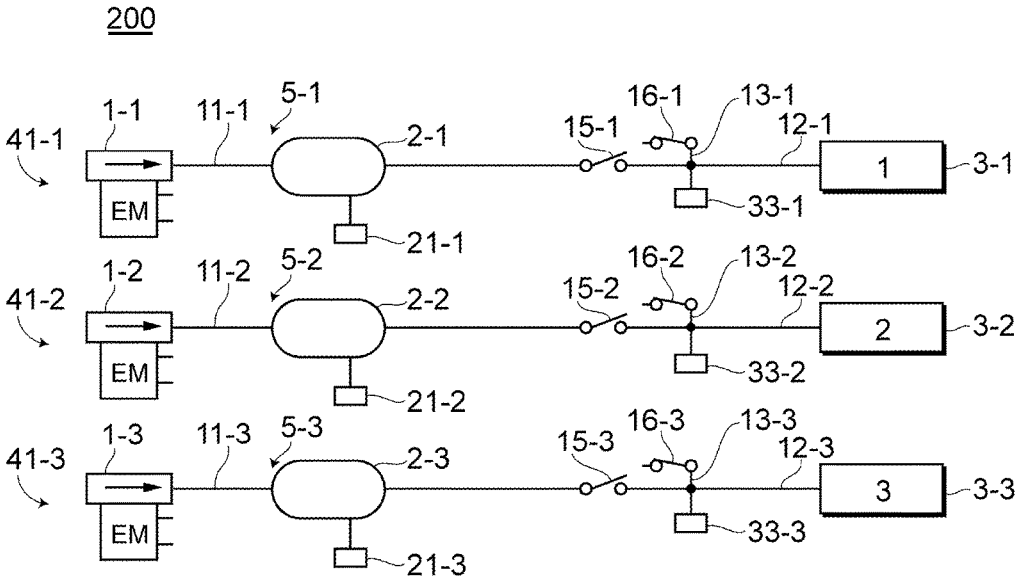
FIG. 1 is a diagram showing an overall configuration of a living body stimulator of a preferred embodiment of the present invention.
Figure 2:
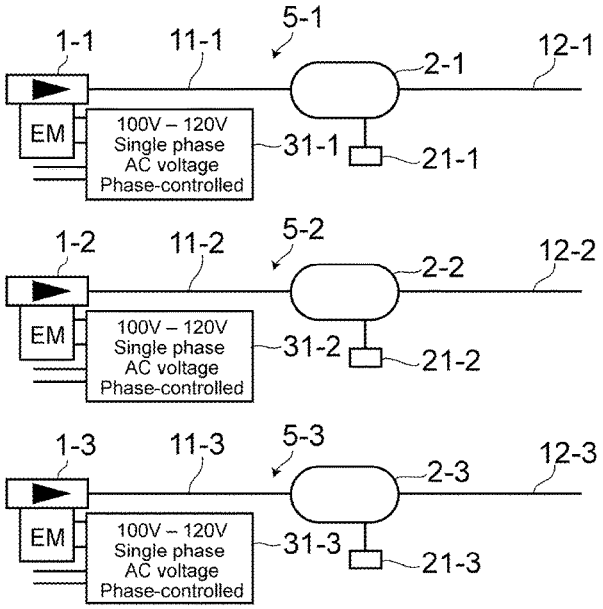
FIG. 2 is a diagram showing a detailed configuration of an air supply circuit of the living body stimulator.

FIG. 1 is a diagram showing an overall structure of an ECP device 200 as a living body stimulator. FIG. 2 is a diagram showing detailed structures of air supply circuits 5-1 to 5-3 that are originally shown in FIG. 1. As shown in each of these diagrams, the structural differences between the ECP device 200 and the conventional ECP device 100 are as follows.

As for the ECP device 200 of this embodiment, the air supply circuits 5-1 to 5-3 sharing an identical structure with one another are individually connected to airbags 3-1 to 3-3. For example, with regard to the air supply circuit 5-1 particularly provided for the airbag 3-1, it is configured in a manner such that the outlet of an air pump 1-1 and the inlet of an air tank 2-1 are communicated with each other through a first flow passage 11-1. Similarly, as for the air supply circuit 5-2 particularly provided for the airbag 3-2, the outlet of an air pump 1-2 and the inlet of an air tank 2-2 are communicated with each other through a first flow passage 11-2. In addition, as for the air supply circuit 5-3 particularly provided for the airbag 3-3, the outlet of an air pump 1-3 and the inlet of an air tank 2-3 are communicated with each other through a first flow passage 11-3.

The air pumps 1-1 to 1-3 used in this embodiment are those of a diaphragm type, and each of these air pumps 1-1 to 1-3 employs a magnet coil EM as a driving source, instead of a conventional motor M. Although not shown, as for each of these diaphragm air pumps 1-1 to 1-3, once the magnet coil EM opposite to a movable part has been electrically conducted via an AC power source, a diaphragm part will reciprocate along with the movable part so as to change the volume of a pump chamber such that the air that has been sucked into the pump chamber can be pressurized and then discharged. This pump shares the same structures as those of general air pumps that are commercially available for septic tank aeration.

Connected to the air pumps 1-1 to 1-3 are pump control devices 31-1 to 31-3 for supplying to the coil parts of the magnet coils EM an output obtained by performing a phase control on, for example, a single-phase AC commercial power source of 100 V to 120 V. These pump control devices 31-1 to 31-3 are individually provided for the corresponding air pumps 1-1 to 1-3; and each of these pump control devices 31-1 to 31-3 has a power plug (not shown) capable of being connected to or disconnected from an existing outlet. That is, by simply inserting such power plug into the existing outlet, a commercial power can be easily supplied to each of the pump control devices 31-1 to 31-3.

Further, the air supply circuits 5-1 to 5-3 include pressure sensors 21-1 to 21-3 for sensing the pressures inside the air tanks 2-1 to 2-3. In this embodiment, although the pressure sensors 21-1 to 21-3 are individually provided for the air tanks 2-1 to 2-3, the conventional leakage valves 22 are not provided. The reason for that is as follows. That is, since this embodiment employs a later-described unique air pressure control configuration, there can be consequently omitted air leakage circuits having the leakage valves 22 that are required for pressure regulation.

Each of the air tanks 2-1 to 2-3 has a single outlet. The outlets of these air tanks 2-1 to 2-3 are individually communicated with the airbags 3-1 to 3-3 through second flow passages 12-1 to 12-3. Even in this embodiment, injection magnetic valves 15-1 to 15-3 are individually interposed on and connected to midway sections of the second flow passages 12-1 to 12-3. Also, on the outlet sides of the injection magnetic valves 15-1 to 15-3, discharge magnetic valves 16-1 to 16-3 are individually interposed on and connected to midway sections of open-air passages 13-1 to 13-3 branching from the second flow passages 12-1 to 12-3. However, pressure sensors 33-1 to 33-3 for sensing the pressures of the airbags 3-1 to 3-3 are individually added to and provided on the sections of the second flow passages 12-1 to 12-3 that extend from the injection magnetic valves 15-1 to 15-3 to the airbags 3-1 to 3-3.

As shown in FIG. 1, the ECP device 200 of this embodiment includes a plurality of pressurization units 41-1 to 41-3. Each of the pressurization units 41-1 to 41-3 is configured in a manner such that one of the air pumps 1-1 to 1-3 and one of the air tanks 2-1 to 2-3 are provided for each of the airbags 3-1 to 3-3. The pressurization units 41-1 to 41-3 are independent from one another, and each of the pressurization units 41-1 to 41-3 allows the air pressurized by each of the air pumps 1-1 to 1-3 to be retained in each of the air tanks 2-1 to 2-3, before supplying the same to each of the airbags 3-1 to 3-3.

Figure 3:
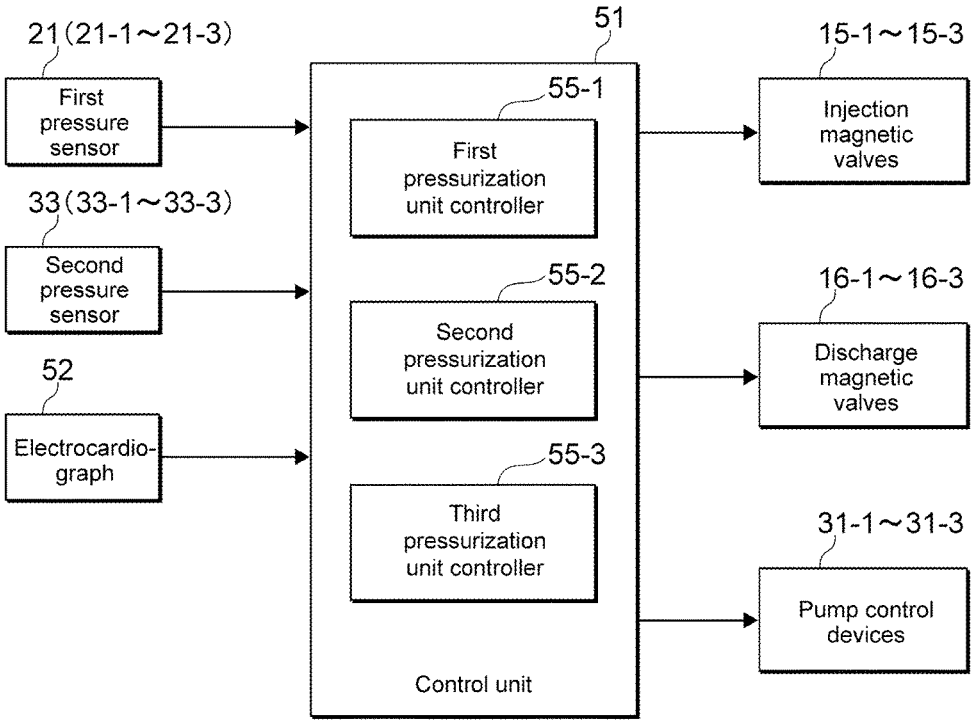
FIG. 3 is a block diagram showing a control system of the living body stimulator.

FIG. 3 is a block diagram showing a control system of the ECP device 200. As shown in FIG. 3, a numerical symbol "51" represents a control unit for individually and independently controlling the operation of each of the pressurization units 41-1 to 41-3. Although not shown in detail, the control unit 51, as is known in the art, includes: a control processing unit composed of a CPU or the like; a timing unit for keeping time; a storage unit for storing, for example, various set values as well as programs; and an input and output parts enabling an external electric connection.

Other than a first pressure sensor 21 corresponding to the pressure sensors 21-1 to 21-3; and a second pressure sensor 33 corresponding to the pressure sensors 33-1 to 33-3, an electrocardiograph 52 to be built in the ECP device 200 is also connected to the input part of the control unit 51. Particularly, the electrocardiograph 52 is a device for recording and measuring the electric activities of a living heart in the form of electrocardiograms (ECG). Here, a sensing signal associated with an electrocardiographic waveform obtained by the electrocardiograph 52 is fetched by the control unit 51. That is, an electrocardio sensing unit other than the electrocardiograph 52 may also be used, as long as the apparatus used is capable of sensing the contraction and dilatation of a heart. Connected to the output part of the control unit 51 are the injection magnetic valves 15-1 to 15-3; the discharge magnetic valves 16-1 to 16-3; and the pump control devices 31-1 to 31-3.

As a software configuration that functions by coordinating with such hardware configuration of the control unit 51 and reading a program(s) from the storage unit, built in the control unit 51 are a first pressurization unit controller 55-1 corresponding to the pressurization unit 41-1; a second pressurization unit controller 55-2 corresponding to the pressurization unit 41-2; and a third pressurization unit controller 55-3 corresponding to the pressurization unit 41-3. The number of the pressurization unit controllers 55-1 to 55-3 is identical to that of the pressurization units 41-1 to 41-3. The first pressurization unit controller 55-1 fetches sensing signals from the pressure sensors 21-1 and 33-1 and the electrocardiograph 52 to individually control the operation of each part of the pressurization unit 41-1, such as the injection magnetic valve 15-1, the discharge magnetic valve 16-1 and the pump control device 31-1. Similarly, the second pressurization unit controller 55-2 fetches sensing signals from the pressure sensors 21-2 and 33-2 and the electrocardiograph 52 to individually control the operation of each part of the pressurization unit 41-2, such as the injection magnetic valve 15-2, the discharge magnetic valve 16-2 and the pump control device 31-2. In addition, the third pressurization unit controller 55-3 fetches sensing signals from the pressure sensors 21-3 and 33-3 and the electrocardiograph 52 to individually control the operation of each part of the pressurization unit 41-3, such as the injection magnetic valve 15-3, the discharge magnetic valve 16-3 and the pump control device 31-3.

The airbags 3-1 to 3-3 are provided as expandable/contractable pressurization cuffs, and can be detachably and individually wound around three regions of the living body which are the upper thigh region, the lower thigh region and the calf region. Here, parts other than the airbags 3-1 to 3-3 shown in FIG. 1 to FIG. 3 are disposed in the main body of a box-type device (not shown). Meanwhile, the front ends of the second flow passages 12-1 to 12-3 that are drawn out of the device main body for use and are connected to the airbags 3-1 to 3-3, are made of, for example, flexible tubes such that the airbags 3-1 to 3-3 can be worn by any part of the living body. Further, in order to improve the storability of the ECP device 200, the airbags 3-1 to 3-3 or the front ends of the second flow passages 12-1 to 12-3 may also be configured as detachable to the device main body.

Described in detail hereunder are features and functions of the related parts of the ECP device 200 having the aforementioned configuration. When installing the ECP device 200, the power plug thereof is to be inserted into an outlet provided on the surface of a wall near the installation site. In this way, a domestic AC power will be supplied from the outlet to, for example, the pump control devices 31-1 to 31-3 through the power plug, such that a DC operating voltage derived from such AC power will then be supplied to, for example, the control unit 51, thereby allowing the ECP device 200 to be used. That is, the stimulator of this embodiment differs from the conventional ECP device 100 in that the ECP device 200 of this embodiment is a power-saving device capable of being used with a limited power from an existing outlet.

Next, the ECP device 200 is used to treat a patient with heart disease by individually winding the airbags 3-1 to 3-3 around the patient's upper thigh region, lower thigh region and calf region which are regions subjected to pressurization. Further, in order to measure the patient's electrocardiographic waveform, the electrode(s) (not shown) of the electrocardiograph 52 are to be attached to a particular region of the patient. Then, after the ECP device 200 has been activated by operating, for example, a power switch (not shown), the pressurization unit controllers 55-1 to 55-3 composing the control unit 51 will individually fetch the pressure sensing signals from the pressure sensors 21-1 to 21-3, 33-1 to 33-3 and electrocardiographic waveform signal from the electrocardiograph 52, in accordance with the corresponding pressurization units 41-1 to 41-3. The pressurization unit controllers 55-1 to 55-3 then individually operate injection magnetic valves 15-1 to 15-3, discharge magnetic valves 16-1 to 16-3 and pump control devices 31-1 to 31-3, all of which being respectively controlled per each of the pressurization units 41-1 to 41-3.

Figure 4:
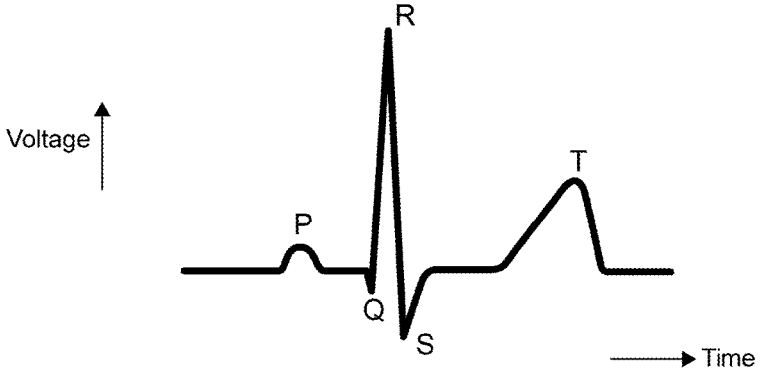
FIG. 4 is a diagram showing a representative electrocardiographic waveform measured by an electrocardiograph for use in the living body stimulator.

Here, the electrocardiographic waveform measured by the electrocardiograph 52 is described with reference to FIG. 4. As shown in FIG. 4, a P wave exhibits a trigger waveform originated from the sinus node associated with atrial activation; an R wave exhibits a waveform associated with the contraction of the heart (i.e. blood pumped out due to ventricular activation); and a T wave exhibits a waveform associated with the dilatation of the heart (i.e. blood returned as ventricular activation ceases). Although shown in FIG. 4 is the electrocardiographic waveform corresponding to only one heartbeat, electrocardiographic waveforms that are substantially identical to one another are actually generated in a repetitive manner. The control unit 51 determines whether or not the R wave indicating the contraction of the heart has reached a peak, by receiving the sensing signal of the electrocardiographic waveform that is outputted from the electrocardiograph 52. Particularly, when the control unit 51 has determined that the R wave has reached the peak, it will cause the injection magnetic valves 15-1 to 15-3 to operate after a set period of time has elapsed, thereby allowing each part of the living body to be pressurized and stimulated at a timing close to when the T wave is generated, thus assisting the dilatation of the heart.

Figure 5:
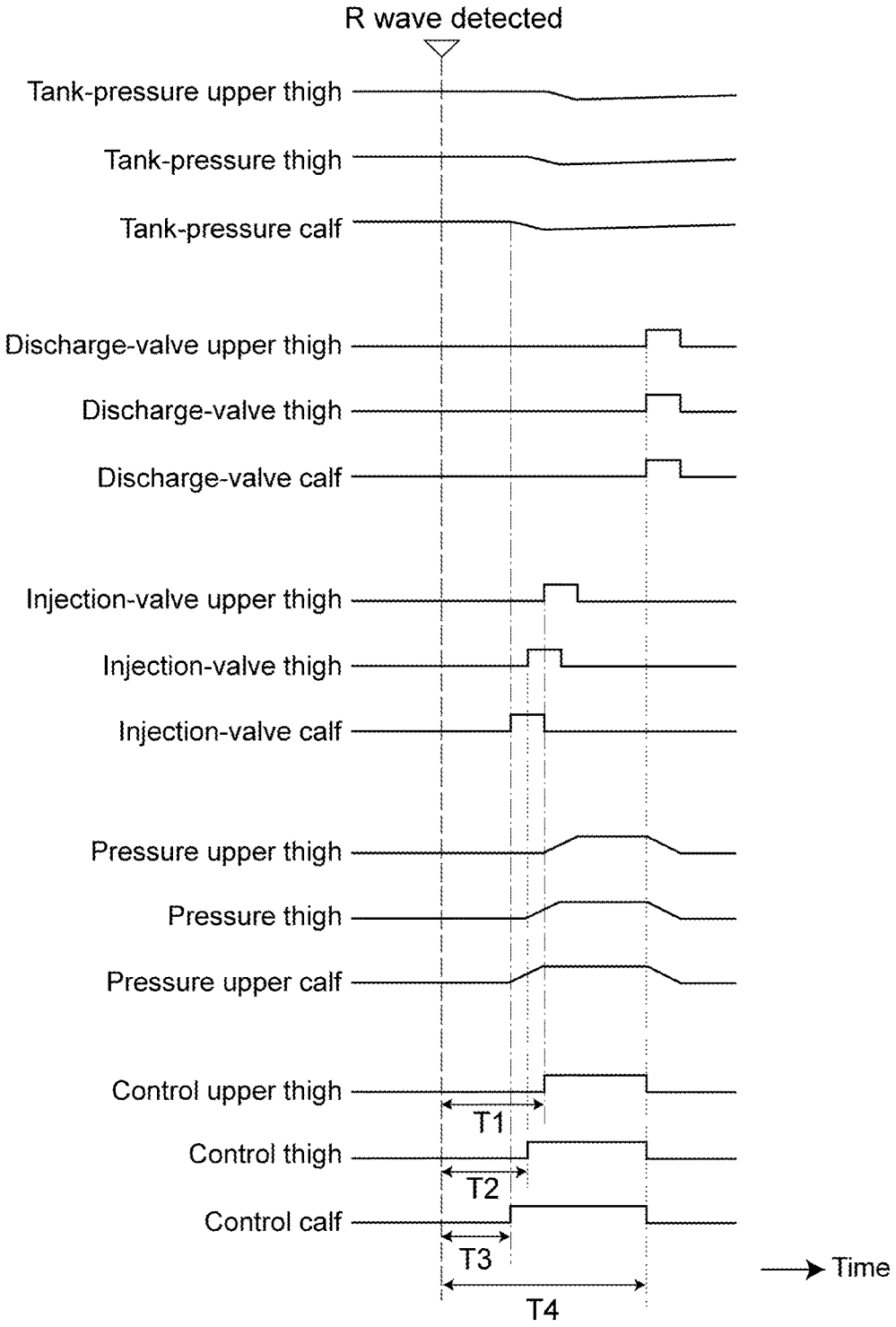
FIG. 5 is a timing chart showing operation states of all the related parts when using the living body stimulator.

FIG. 5 is a timing chart showing operation states of all the related parts when using the ECP device 200. As shown in FIG. 5, "Tank-pressure upper thigh" on the uppermost row indicates the pressure inside the air tank 2-1 that is sensed by the pressure sensor 21-1; "Tank-pressure thigh" on the next row indicates the pressure inside the air tank 2-2 that is sensed by the pressure sensor 21-2; and "Tank-pressure calf" indicates the pressure inside the air tank 2-2 that is sensed by the pressure sensor 21-3. Further, "Discharge-valve upper thigh" indicates an open/closed state of the discharge magnetic valve 16-1; "Discharge-valve thigh" indicates an open/closed state of the discharge magnetic valve 16-2; and "Discharge-valve calf" indicates an open/closed state of the discharge magnetic valve 16-3. Furthermore, "Injection-valve upper thigh" indicates an open/closed state of the injection magnetic valve 15-1; "Injection-valve thigh" indicates an open/closed state of the injection magnetic valve 15-2; and "Injection-valve calf" indicates an open/closed state of the injection magnetic valve 15-3. Particularly, while the inlet and outlet of the valve are communicated with each other in the open state, they are blocked from each other in the closed state.

Furthermore, "Pressure upper thigh" indicates the pressure inside the airbag 3-1 that is sensed by the pressure sensor 33-1; "Pressure thigh" indicates the pressure inside the airbag 3-2 that is sensed by the pressure sensor 33-2; and "Pressure upper calf" indicates the pressure inside the airbag 3-3 that is sensed by the pressure sensor 33-3. Furthermore, "Control upper thigh" indicates a first valve-opening control signal sent from the first pressurization unit controller 55-1 to a first magnetic valve (composed of the injection magnetic valve 15-1 and discharge magnetic valve 16-1); "Control thigh" indicates a second valve-opening control signal sent from the second pressurization unit controller 55-2 to a second magnetic valve (composed of the injection magnetic valve 15-2 and discharge magnetic valve 16-2); and "Control calf" indicates a third valve-opening control signal sent from the third pressurization unit controller 55-3 to a third magnetic valve (composed of the injection magnetic valve 15-3 and discharge magnetic valve 16-3).

The operations of the air supply circuits 5-1 to 5-3 are described in the beginning. That is, the pressurization unit controllers 55-1 to 55-3 serve to close the corresponding injection magnetic valves 15-1 to 15-3, and then monitor the pressures inside the air tanks 2-1 to 2-3 or the air pumps 1-1 to 1-3 based on the sensing signals from the pressure sensors 21-1 to 21-3 when the air supply circuits 5-1 to 5-3 are disconnected from the airbags 3-1 to 3-3. Next, phase control signals are sent from the pressurization unit controllers 55-1 to 55-3 to the corresponding pump control devices 31-1 to 31-3 such that the aforementioned pressures become not lower than preset values or remain within preset ranges. Upon receiving such phase control signals, the pump control devices 31-1 to 31-3 will then individually output a phase-controlled AC power to the magnet coils EM of the air pumps 1-1 to 1-3.

On this point, as for the conventional ECP device 100, the pressure of the air discharged from the large-size air pump 1 has often been controlled by changing the revolutions of the motor M built in such air pump 1. In such case, the revolutions of the motor M are actually changed by controlling the power frequency via an inverter. In contrast, in this embodiment, the number of the multiple air pumps 1-1 to 1-3 is identical to that of the airbags 3-1 to 3-3. Therefore, the air capacity of each of the air pumps 1-1 to 1-3 can be reduced such that the diaphragm air pumps 1-1 to 1-3 using the magnet coils EM can be employed as well.

Each of the diaphragm air pumps 1-1 to 1-3 has a simple structure utilizing the attractive and repulsive forces between the electromagnet of the magnet coil EM and the movable part. For this reason, there is no need to install expensive inverters in the pump control devices 31-1 to 31-3 for controlling the magnet coils EM. Alternatively, phase control can now be performed by using, for example, a solid state relay (SSR), which significantly contributes to simplifying each of the pump control devices 31-1 to 31-3 and enhancing the efficiency thereof. Further, since the diaphragm air pumps 1-1 to 1-3 using the magnet coils EM are widely available in the market, not only the delivery period of the ECP device 200 can be shortened, but the cost thereof can also be reduced.

In the embodiment of the present invention, open/closed periods of the discharge magnetic valves 16-1 to 16-3 and injection magnetic valves 15-1 to 15-3 are individually controlled in general use such that the pressures inside the airbags 3-1 to 3-3 become those required for treatment. Thus, the pressures of the air pumps 1-1 to 1-3 are hardly required to be adjusted based on the phase control of the AC power. That is, in most cases, before or after the airbags 3-1 to 3-3 pressurize the treatment areas, it is only required to perform a conduction/non-conduction control over the AC power supplied to the magnet coils EM on a 0%/100% basis such that the air pumps 1-1 to 1-3 will stop working once the pressures of the air tanks 2-1 to 2-3 that are sensed by the pressure sensors 21-1 to 21-3 have reached the preset values. For this reason, phase control is not required in the embodiment of the present invention. In FIG. 5, the pressures inside the air tanks 2-1 to 2-3 (e.g. "Tank-pressure upper thigh," "Tank-pressure thigh" and "Tank-pressure calf") result from the conduction/non-conduction control performed over the AC power, and are maintained within certain ranges. However, it is assumed that the phase control over the AC power is required when treating, for example, a patient exhibiting an extremely slow pulse; or a patient requiring an extremely low set value of pressure.

Described hereunder are operations of parts other than the air supply circuits 5-1 to 5-3. In this embodiment, when the electrocardiograph 52 has sensed the peak of the R wave of the electrocardiographic waveform with the pressures of the air pumps 1-1 to 1-3 or air tank 2-1 to 2-3 being maintained in a given range higher than the atmospheric pressure, the first pressurization unit controller 55-1 will switch the level of the first valve-opening control signal from a L (Low) level to a H (High) level after a first preset period T1 has elapsed from the moment when the peak of the R wave was sensed. In this way, as for the first pressurization unit 41-1, while the discharge magnetic valve 16-1 is maintained closed, the injection magnetic valve 15-1 is to be switched from the closed state to the open state, thereby causing the pressurized air retained in the air tank 2-1 to be supplied to the airbag 3-1, thus allowing the airbag 3-1 to start expanding.

Similarly, the second pressurization unit controller 55-2 switches the level of the second valve-opening control signal from the L level to the H level, when a second preset period T2 has elapsed from the moment when the peak of the R wave of the electrocardiographic waveform was sensed by the electrocardiograph 52. Thus, as for the second pressurization unit 41-2, while the discharge magnetic valve 16-2 is maintained closed, the injection magnetic valve 15-2 is to be switched from the closed state to the open state, thereby causing the pressurized air retained in the air tank 2-2 to be supplied to the airbag 3-2, thus allowing the airbag 3-2 to start expanding. Likewise, the third pressurization unit controller 55-3 switches the level of the third valve-opening control signal from the L level to the H level, when a third preset period T3 has elapsed from the moment when the peak of the R wave of the electrocardiographic waveform was sensed by the electrocardiograph 52. Therefore, as for the third pressurization unit 41-3, while the discharge magnetic valve 16-3 is maintained closed, the injection magnetic valve 15-3 is to be switched from the closed state to the open state, thereby causing the pressurized air retained in the air tank 2-3 to be supplied to the airbag 3-3, thus allowing the airbag 3-3 to start expanding.

As representative values, when the first preset period T1 is set to 300 mSec; the second preset period T2 is set to 250 mSec; and the third preset period T3 is set to 200 mSec, the calf region will first be pressurized 200 mSec after the electrocardiograph 52 has sensed the peak of the R wave of the electrocardiographic waveform. The lower thigh region will be pressurized after a delay of 50 mSec therefrom; and the upper thigh region will then be pressurized after a delay of yet another 50 mSec. These timings for pressurizing the related regions substantially correspond to cardiac diastoles. However, in view of individual differences among patients, there may be employed a configuration allowing the preset periods to be changed.

As a result of injecting the pressurized air into each of the airbags 3-1 to 3-3 at the aforementioned timings, while the injection magnetic valves 15-1 to 15-3 are remaining open, although the pressures of the airbags 3-1 to 3-3 will gradually increase, the pressures of the air tanks 2-1 to 2-3 corresponding to the airbags 3-1 to 3-3 will gradually decrease. At that time, the pressurization unit controllers 55-1 to 55-3 do not read sensing signals from the pressure sensors 21-1 to 21-3 that are individually disposed on the air tanks 2-1 to 2-3, but from the output ports of the ECP device 200 i.e. the pressure sensors 33-1 to 33-3 that are provided on the regions of the second flow passages 12-1 to 12-3 beyond the injection magnetic valves 15-1 to 15-3. Next, when the pressure values sensed by the pressure sensors 33-1 to 33-3 have reached preset and stored upper limits, a valve-closing control signal (not shown in FIG. 5) for switching each of the injection magnetic valves 15-1 to 15-3 from the open state to the closed state will be sent out with the discharge magnetic valve 16-2 remaining closed, thus causing the airbags 3-1 to 3-3 to be disconnected from the air tanks 2-1 to 2-3. In this way, the air that has been injected into the airbags 3-1 to 3-3 will be disconnected from the outside, thus allowing the pressures of the airbags 3-1 to 3-3 to be maintained until discharge takes place as the discharge magnetic valve 16-3 is switched from the closed state to the open state for the next time.

In this way, after all the airbags 3-1 to 3-3 have expanded, once a fourth preset period T4 has elapsed from the moment when the electrocardiograph 52 sensed the peak of the R wave of the electrocardiographic waveform, the first to the third pressurization unit controllers 55-1 to 55-3 will switch the first to the third valve-opening control signals form the H level to the L level at the same timing. For this reason, in the pressurization units 41-1 to 41-3, while the injection magnetic valves 15-1 to 15-3 remain closed, the discharge magnetic valves 16-1 to 16-3 are to be switched from the closed state to the open state at the same time, thus allowing the pressurized air in the airbags 3-1 to 3-3 to be discharged to the outside through the open-air passages 13-1 to 13-3.

While the discharge magnetic valves 16-1 to 16-3 are remaining open at the aforementioned timing, the pressures of the airbags 3-1 to 3-3 increase gradually. However, since the injection magnetic valves 15-1 to 15-3 are closed, the pressures of the air pumps 1-1 to 1-3 or the air tanks 2-1 to 2-3 are independent of the pressures of the airbags 3-1 to 3-3 even when the discharge magnetic valves 16-1 to 16-3 are open. When the pressure values sensed by the pressure sensors 33-1 to 33-3 have reached the preset and stored lower limit values, the pressurization unit controllers 55-1 to 55-3 will send out the valve-closing control signals (not shown in FIG. 5) for switching the discharge magnetic valves 16-1 to 16-3 from the open state to the closed state, while maintaining the closed states of the injection magnetic valves 15-1 to 15-3. In this way, the airbags 3-1 to 3-3 will stop discharging the pressurized air therefrom; and will maintain the pressures thereof with the airbags 3-1 to 3-3 themselves being in contracted states, until the pressurized air is injected for the next time as the injection magnetic valves 15-1 to 15-3 are switched from the closed state to the open state.

As for the aforementioned sequence of actions, in order to achieve a low power consumption of the air pumps 1-1 to 1-3 and a low air consumption of the air supply circuits 5-1 to 5-3, it is effective to control the pressures of the air pumps 1-1 to 1-3 and air tanks 2-1 to 2-3 such that these pressures remain in given ranges, and to stop the operations of the air pumps 1-1 to 1-3 when no air is being consumed (idling stop). As described above, this may be accomplished by incorporating an electric conduction/non-conduction control configuration into the pump control devices 31-1 to 31-3 other than performing the phase control on the AC power supplied to the air pumps 1-1 to 1-3.

The conventional ECP device 100 is regulated by reading the pressure inside the air tank 2 through the pressure sensor 21 so as to allow the value of this pressure to become a preset value. However, in order to regulate the pressures of the airbags 3-1 to 3-3 to appropriate pressures, it is required that the injection magnetic valves 15-1 to 15-3 be opened and that air be able to travel back and forth (at the same pressure) between the air tank 2 and the airbags 3-1 to 3-3. In contrast, the present embodiment allows the pressures of the airbags 3-1 to 3-3 to swiftly become the preset values in the following manners. That is, the pressures of the airbags 3-1 to 3-3 are controlled while having the pressures of the output ports of the ECP device 200 sensed by the pressure sensors 33-1 to 33-3, thus allowing the pressures of the airbags 3-1 to 3-3 to be stably and precisely regulated in a short period of time.

Further, the pressure of each of the air tanks 2-1 to 2-3 basically changes (usually decreases) every time the pressurized air is consumed. In the present embodiment, this problem is at first solved as follows. That is, when the pressures sensed by the pressure sensors 33-1 to 33-3 have reached the preset upper limit values, the injection magnetic valves 15-1 to 15-3 will be closed, thus causing the airbags 3-1 to 3-3 and the air tanks 2-1 to 2-3 to be disconnected from one another. Here, the pressures of the output ports of the ECP device 200 are monitored in a micro-scale from the beginning of injecting the air into the airbags 3-1 to 3-3, and such pressures gradually increase from the atmospheric pressure. Therefore, by switching the injection magnetic valves 15-1 to 15-3 form the open state to the closed state at the moment when these pressures have reached the preset upper limit values, the air that is already in the airbags 3-1 to 3-3 will be disconnected from the outside, thus allowing the pressure of such air to be maintained until discharge takes place. By controlling the pressure in such manner, there occurs no problem even when there are changes in some degree in the pressures of the air tanks 2-1 to 2-3 as sources for supplying air to the airbags 3-1 to 3-3. Further, the pressures can thus be easily controlled, since the pressures of the air pumps 1-1 to 1-3 are only required to become not lower than the preset values, thus making it possible to even eliminate pressure control, provided that there exists no problem in the power consumption of the air pumps 1-1 to 1-3 and the performances thereof.

Here, since the magnetic valves serve to mechanically open and close air passages, it is impossible to avoid a delay in a time between the electric conduction and the opening or closing of the valves. Therefore, regardless of how high-speed the magnetic valves used are, there is no way that such delay can be resolved if the injection magnetic valves 15-1 to 15-3 are operated after the control unit 51 has acquired as pressure information the sensing signals from the pressure sensors 33-1 to 33-3. For this reason, all the first to third pressurization unit controllers 55-1 to 55-3 of the present embodiment are configured as follows. That is, with the airbags 3-1 to 3-3 repeating expansion and contraction, the last several pressure values sensed by the pressure sensors 33-1 to 33-3 are utilized. Particularly, delay times that occur before the injection magnetic valves 15-1 to 15-3 are opened or closed are predicted based on the moving average of these pressure values utilized, thereby allowing the pressures of the airbags 3-1 to 3-3 to be precisely controlled.

Figure 6A:
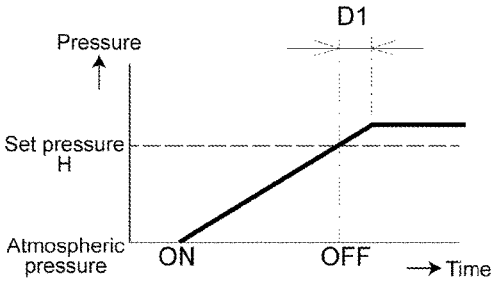
FIG. 6A is a graph showing a change in a pressure value of an airbag with respect to an electric conduction timing of an injection magnetic valve in the embodiment, when a delay prediction control is not available.
Figure 6B:
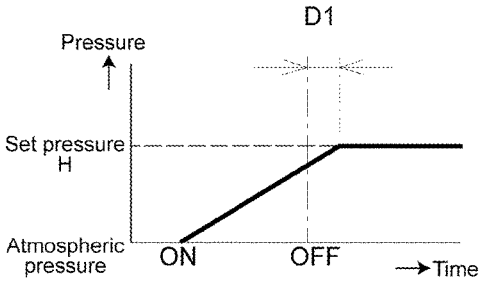
FIG. 6B is a graph showing the change in the pressure value of the airbag to the electric conduction timing of the injection magnetic valve in the embodiment, when the delay prediction control is available.

FIG. 6A and FIG. 6B are graphs showing changes in the pressure values of the airbags 3-1 to 3-3 that are sensed by the pressure sensors 33-1 to 33-3 with respect to electric conduction timings of the injection magnetic valves 15-1 to 15-3, when injecting the pressurized air into the airbags 3-1 to 3-3. In each of FIG. 6A and FIG. 6B, "ON" represents a timing for turning on the electric conduction of the injection magnetic valves 15-1 to 15-3; "OFF" represents a timing for turning off the electric conduction of the injection magnetic valves 15-1 to 15-3.

As shown in FIG. 6A, when a delay prediction control for the injection magnetic valves 15-1 to 15-3 is not available, the electric conduction of the injection magnetic valves 15-1 to 15-3 is turned from ON to OFF at the timing when the pressure values of the airbags 3-1 to 3-3 have reached a "preset pressure H" i.e. the preset upper limit values. However, since a delay time D1 occurs between such timing and the moment when the injection magnetic valves 15-1 to 15-3 are closed, the actual pressure values inevitably exceed the preset pressure values, thus failing to precisely control the pressures.

In contrast, as shown in FIG. 6B, when a delay prediction control for the injection magnetic valves 15-1 to 15-3 is incorporated into the first to third pressurization unit controllers 55-1 to 55-3, after the electric conduction of the injection magnetic valves 15-1 to 15-3 has been turned from ON to OFF, the delay time D1 occurring before the pressure values of the airbags 3-1 to 3-3 have become constant will be read multiple times, followed by calculating the moving average value thereof and then storing the same. After the conduction of the injection magnetic valves 15-1 to 15-3 has been turned from OFF to ON, the first to third pressurization unit controllers 55-1 to 55-3 will serve to calculate a gradient (amount of change in given period of time) of the pressure values of the airbags 3-1 to 3-3; and then turn the electric conduction of the injection magnetic valves 15-1 to 15-3 from ON to OFF at a timing obtained by subtracting the delay time D1 from the time point when the pressure values are predicted to reach the preset upper limit values and remain constant thereafter. In this way, based on the multiple delay times D1, the electric conduction-switching timing for closing the injection magnetic valves 15-1 to 15-3 is adjusted such that the pressure values of the airbags 3-1 to 3-3 that are sensed by the pressure sensors 33-1 to 33-3 become constant at the preset upper limit values, thus allowing the pressures to be precisely controlled.

At an initial stage of the operation of the ECP device 200, the pressures of the airbags 3-1 to 3-3 may not be stably controlled to the preset value. However, as mentioned above, the present embodiment allows the data (pressure values) from the last use to be stored in a non-volatile memory of the storage unit, and a moving average value is then calculated based on such data, thus making it possible to precisely control the pressures in a short period of time.

Figure 7:
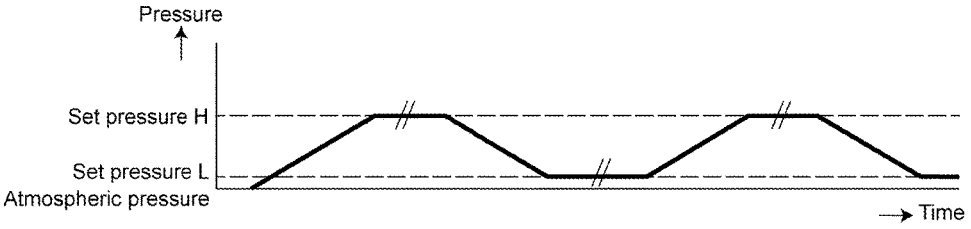
FIG. 7 is a graph showing the change in the pressure value of the airbag of the embodiment with time.

In the present embodiment, other than the injection magnetic valves 15-1 to 15-3 for injecting air into the airbags 3-1 to 3-3, the discharge magnetic valves 16-1 to 16-3 for discharging air from the airbags 3-1 to 3-3 are individually installed in the first to third pressurization units 41-1 to 41-3. FIG. 7 is a graph showing changes in the pressure values of the airbags 3-1 to 3-3 with time. Particularly, the first to third pressurization unit controllers 55-1 to 55-3 serve to control the discharge magnetic valves 16-1 to 16-3 in the same manner as the injection magnetic valves 15-1 to 15-3.

In FIG. 7, a "preset pressure L" as the preset lower limit value is higher than the atmospheric pressure and allows the pressurized air to remain inside the airbags 3-1 to 3-3. That is, with the discharge magnetic valves 16-1 to 16-3 being open and the pressurized air from the airbags 3-1 to 3-3 being thus discharged to the outside, once the pressures of the airbags 3-1 to 3-3 have reached the preset lower limit values, the discharge magnetic valves 16-1 to 16-3 will be closed, thus causing an air pressure slightly higher than the atmospheric pressure to remain inside the airbags 3-1 to 3-3. For this reason, the airbags 3-1 to 3-3 are allowed to undergo the least deformation due to the expansion and contraction thereof, thereby reducing the air consumption of the ECP device 200. Further, when injecting air into the airbags 3-1 to 3-3 for the next time, by reducing the degree of changes in the shapes of the airbags 3-1 to 3-3, the impact inflicted upon the patient can be alleviated, and the air consumption of the ECP device 200 can be reduced, thus making it possible to further downsize the air pumps 1-1 to 1-3 and achieving a low power consumption thereof.

Figure 8:
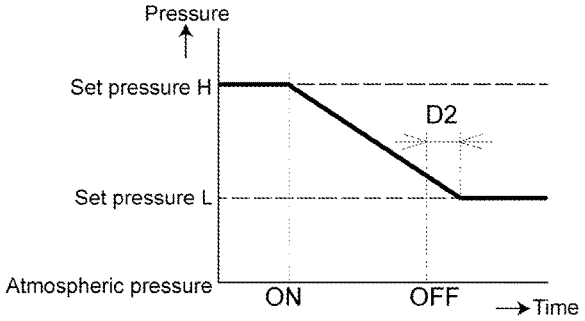
FIG. 8 is a graph showing the change in the pressure value of the airbag to an electric conduction timing of the discharge magnetic valve in the embodiment, when the delay prediction control is available.

The delay prediction control described with reference to FIG. 6A and FIG. 6B can also be applied to the discharge magnetic valves 16-1 to 16-3. FIG. 8 is a graph showing the changes in the pressure values of the airbags 3-1 to 3-3 with respect to the electric conduction timings of the discharge magnetic valves 16-1 to 16-3 at the time of discharging the pressurized air from the airbags 3-1 to 3-3, when a delay prediction control is incorporated into the first to third pressurization unit controllers 55-1 to 55-3. In FIG. 8, "ON" represents a timing for turning on the electric conduction of the discharge magnetic valves 16-1 to 16-3; "OFF" represents a timing for turning off the electric conduction of the discharge magnetic valves 16-1 to 16-3.

Also in such case, the electric conduction of the discharge magnetic valves 16-1 to 16-3 has been turned from ON to OFF, a delay time D2 occurring before the pressure values of the airbags 3-1 to 3-3 have become constant will be read multiple times, followed by calculating the moving average value thereof and then storing the same. After the conduction of the discharge magnetic valves 16-1 to 16-3 has been turned from OFF to ON, the first to third pressurization unit controllers 55-1 to 55-3 will serve to calculate a gradient of the pressure values of the airbags 3-1 to 3-3; and then turn the electric conduction of the discharge magnetic valves 16-1 to 16-3 from ON to OFF at a timing estimated by subtracting the delay time D2 from the time point when the pressure values are predicted to reach the preset lower limit values and remain constant thereafter. In this way, based on the multiple delay times D2, the electric conduction-switching timing for closing the discharge magnetic valves 16-1 to 16-3 is adjusted such that the pressure values of the airbags 3-1 to 3-3 become constant at the preset lower limit values, thus allowing the pressures to be precisely controlled.

In addition, as for the conventional ECP device 100, the airbags 3-1 to 3-3 are individually worn by the three regions which are the upper thigh region, the lower thigh region and the calf region, and the air is supplied from a pair of the large-size air pump 1 and air tank 2. In contrast, as for the ECP device 200 of the present embodiment, there are prepared three pairs of the small-size air pumps 1-1 to 1-3 and air tanks 2-1 to 2-3 to individually control the pressures of the airbags 3-1 to 3-3. Therefore, the pressures of the airbags 3-1 to 3-3 corresponding to the three regions can be individually set. That is, when the patient claims that a pain has occurred due to an imbalance in the pressures, his/her pain can be alleviated by only adjusting the pressure of the claimed region without having to decrease an overall pressure, thereby avoiding as much as possible a decrease in the treatment effect duet to an decrease in the pressure. The noticeable advantage of downsizing the air pumps 1-1 to 1-3 is that general air pumps 1-1 to 1-3 available in the market can be used.

In addition, by downsizing the air tanks 2-1 to 2-3, there can be used pressure containers even smaller than the smallest pressure container domestically defined by law as a (simple) container in Japan (item (xxvi), Article 13 of Enforcement Order of Industrial Safety and Health Act). These containers exhibit low inner pressures and are not subjects to regulations.

Figure 9:
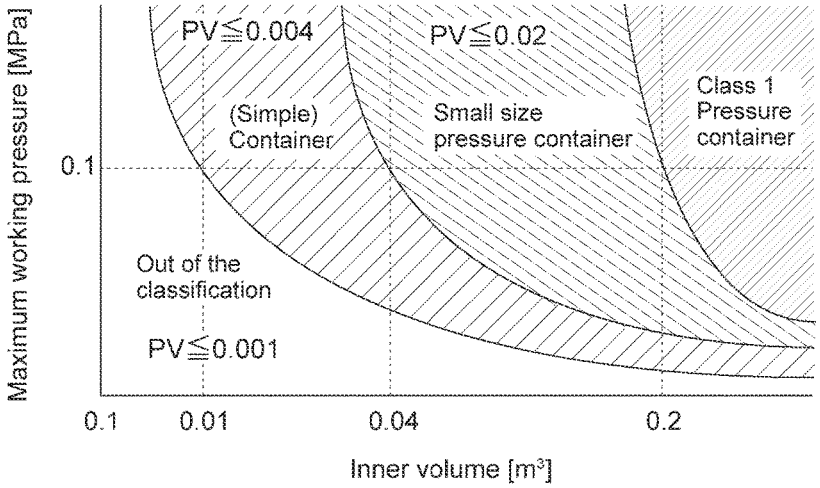
FIG. 9 is a graph showing classifications of containers from the perspectives of maximum permissible working pressure and inner volume.
Figure 10:
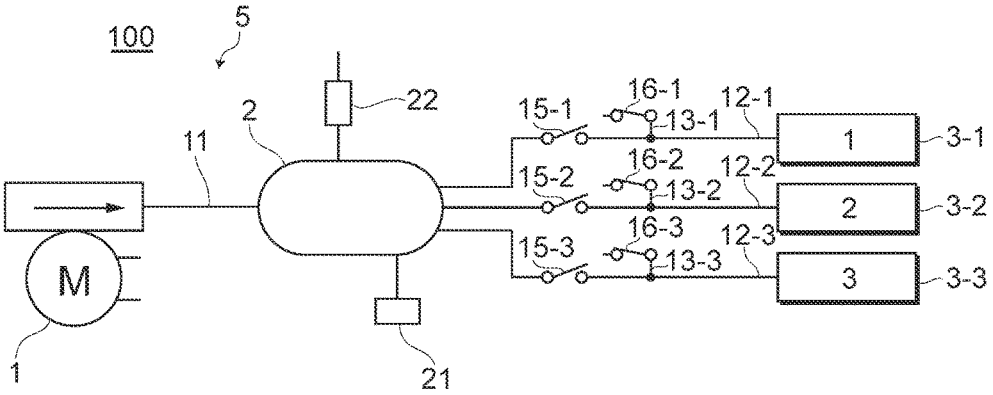
FIG.10 Prior art
FIG. 10 is a diagram showing an overall configuration of a conventional living body stimulator.
Figure 11:
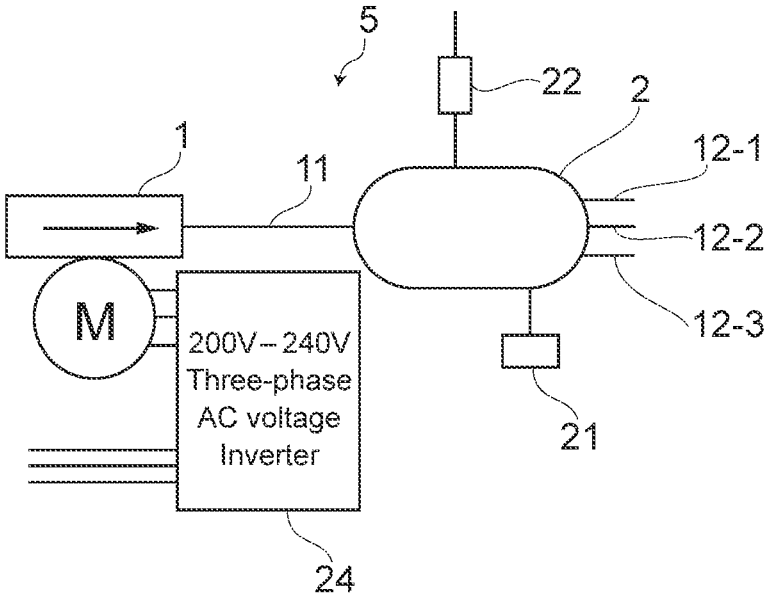
FIG.11 Prior art
FIG. 11 is a diagram showing a detailed structure of a conventional air supply circuit.

FIG. 9 is a graph showing classifications of containers from the perspectives of maximum working pressure and inner volume. As shown in FIG. 9, a container exhibiting a product $P \times V$ not larger than 0.001 ($P \times V \leq 0.001$) is classified as a container that is smaller than the simple container and is thus not subject to regulations, where P is a numerical value of the maximum gauge pressure in terms of megapascal (or denoted as "MPa" hereinafter) employed by a container, and where V is a numerical value of the inner volume ($m^3$) of the container. It is preferred that the air tanks (pressure containers) 2-1 to 2-3 be downsized such that these requirements are met. That is, as long as the safety of these air tanks 2-1 to 2-3 are ensured, even companies holding no such license are capable of freely designing the containers. Further, the shapes of the air tanks 2-1 to 2-3 can now be formed rational enough to be fitted in the site of installation, thereby requiring no further professional manufacturer to be commissioned, thus making it possible to produce the air tanks 2-1 to 2-3 in a short delivery period and at a low cost.

For example, in order to form the air tanks 2-1 to 2-3 into containers that are not subjects to the aforementioned regulations, the inner volume of each of them needs to be not larger than 10 liters (=0.01 $m^3$), provided that the maximum working pressure of each of the pressurization units 41-1 to 41-3 that can never be exceeded is 0.1 MPa (=100 kPa).

As mentioned above, the ECP device 200 as a living body stimulator of the present embodiment includes the air pumps 1-1 to 1-3 as pumps for generating the pressurized air; and the air tanks 2-1 to 2-3 as tanks for retaining the pressurized air from the air pumps 1-1 to 1-3. Particularly, the pressurized air from the air tanks 2-1 to 2-3 is supplied to the multiple airbags 3-1 to 3-3 as pressurization bags worn by the patient as a living body, thereby making it possible to pressurize and thus stimulate the patient. Especially, each of the number of the multiple air pumps 1-1 to 1-3 and the number of the multiple air tanks 2-1 to 2-3, is identical to that of the multiple airbags 3-1 to 3-3. Further, each of the air pumps 1-1 to 1-3 and each of the air tanks 2-1 to 2-3 are individually provided with respect to each of the airbags 3-1 to 3-3 to form the multiple pressurization units 41-1 to 41-3. Furthermore, the ECP device 200 includes the control unit 51 capable of individually and independently controlling the operation of each of the pressurization units 41-1 to 41-3.

In this case, each of the air pumps 1-1 to 1-3 and each of the air tanks 2-1 to 2-3 are individually provided for each of the airbags 3-1 to 3-3. That is, as for each of the pressurization units 41-1 to 41-3, the pressurized air is supplied from, for example, one air pump 1-1 to one airbag 3-1 through one air tank 2-1. In addition, the control unit 51 serves to individually and independently control the multiple pressurization units 41-1 to 41-3. For this reason, it is possible to individually downsize the air pumps 1-1 to 1-3 and air tanks 2-1 to 2-3 that are dispersedly provided in the pressurization units 41-1 to 41-3. Therefore, there is no need to use the special and large-size pump 1 and tank 2 as is the case for the conventional device, thus making it possible to not only save the power consumption of and reduce the weight of the ECP device 200, but also improve the degree of freedom of the outer shape of the device.

The pressurization units 41-1 to 41-3 of the present embodiment individually include the injection magnetic valves 15-1 to 15-3 as injection valves for opening and closing the second flow passages 12-1 to 12-3 as flow passages disposed between the air tanks 2-1 to 2-3 and the airbags 3-1 to 3-3; and the pressure sensors 33-1 to 33-3 as bag pressure sensing units provided on the outlet sides of the injection magnetic valves 15-1 to 15-3. Further, the control unit 51 receives the sensed outputs from the pressure sensors 33-1 to 33-3 to send out the control signals to the injection magnetic valves 15-1 to 15-3, thereby making it possible to individually control the pressure of each of the airbags 3-1 to 3-3 per each of the pressurization units 41-1 to 41-3.

In this case, the pressures of the air tanks 2-1 to 2-3 gradually decrease every time the injection magnetic valves 15-1 to 15-3 are opened to communicate the air tanks 2-1 to 2-3 and the airbags 3-1 to 3-3 with one another. However, in the present embodiment, the pressures of the airbags 3-1 to 3-3 are not regulated by sensing the pressures of the air tanks 2-1 to 2-3. Instead, with regard to the pressurization units 41-1 to 41-3, the pressures of the airbags 3-1 to 3-3 are individually controlled by sensing the pressures of the outlet sides of the injection magnetic valves 15-1 to 15-3. For this reason, the air volume on the air supply circuit 5-1 to 5-3 sides composed of the air pumps 1-1 to 1-3 and the air tanks 2-1 to 2-3 can be reduced, thus shortening a pressure restoration time of each of the air tanks 2-1 to 2-3.

After the pressurized air from the air tanks 2-1 to 2-3 has started being injected into the airbags 3-1 to 3-3 as a result of opening the injection magnetic valves 15-1 to 15-3, the control unit 51 of the present embodiment will serve to close the injection magnetic valves 15-1 to 15-3 through control regulation when the pressure values sensed by the pressure sensors 33-1 to 33-3 have reached the preset upper limit values.

In this case, once the pressures of the airbags 3-1 to 3-3 that are sensed by the pressure sensors 33-1 to 33-3 have reached the preset upper limit values, the air tanks 2-1 to 2-3 will be disconnected from the airbags 3-1 to 3-3, thereby allowing each of the airbags 3-1 to 3-3 to maintain its pressure. That is, it is only required that the pressures of the air tanks 2-1 to 2-3 be in given ranges. For this reason, it is possible to eliminate the conventional air leakage circuit having the leakage valve 22 for adjusting the tank pressure. Further, the required amounts of the pressurized air in the air tanks 2-1 to 2-3 can be reduced, thus making it possible to downsize and lower the power consumption of the air pumps 1-1 to 1-3.

The control unit 51 of the present embodiment allows the pressures of the airbags 3-1 to 3-3 to be individually set with respect to each of the pressurization units 41-1 to 41-3.

In this case, the pressures that are applied to the treatment areas wearing the airbags 3-1 to 3-3 are independently controlled from one other. Therefore, by individually setting the pressures of the airbags 3-1 to 3-3 with respect to each of the pressurization units 41-1 to 41-3, pressures suitable for each of the treatment areas can be individually applied from the airbags 3-1 to 3-3. Thus, particular requests of each patient can be met, thus making it possible to alleviate the pain of the patient.

The control unit 51 of the present embodiment allows the pressures of the airbags 3-1 to 3-3 to be set every time the injection magnetic valves 15-1 to 15-3 as magnetic valves are opened to inject the pressurized air from the air tanks 2-1 to 2-3 into the airbags 3-1 to 3-3.

In this case, the pressures of the airbags 3-1 to 3-3 are controlled by opening and closing the injection magnetic valves 15-1 to 15-3 as magnetic valves. Thus, by setting the pressures of the airbags 3-1 to 3-3 every time the pressurized air is injected into the airbags 3-1 to 3-3, the pressures of the airbags 3-1 to 3-3 can be changed in a short period of time.

In the present embodiment, the pressurization units 41-1 to 41-3 are individually provided with the pressure sensors 21-1 to 21-3 as tank pressure sensing units for sensing the pressures inside the air tanks 2-1 to 2-3. By receiving the sensed outputs from the pressure sensors 21-1 to 21-3, the control unit 51 is capable of individually controlling the operation of each of the air pumps 1-1 to 1-3 with respect to each of the pressurization units 41-1 to 41-3.

In this case, the pressures of the airbags 3-1 to 3-3 are not controlled by sensing the pressure of the air tank 2 through the pressure sensor 21 as is the case for the conventional device. Instead, the pressures of the airbags 3-1 to 3-3 are precisely controlled by sensing the pressures of the outlet sides of the injection magnetic valves 15-1 to 15-3 that serve as the air outlets of the ECP device 200. That is, the pressures of the air tanks 2-1 to 2-3 are considered as less significant. For this reason, the operations of the air pumps 1-1 to 1-3 can be controlled in a less sophisticated manner. That is, various kinds of pumps susceptible to load changes can be employed, without having to purposefully use a high-powered rotary pump.

The control unit 51 of the present embodiment serves to read multiple times the delay time D1 between when electric conduction is switched to close the injection magnetic valves 15-1 to 15-3 and when the pressure values sensed by the pressure sensors 33-1 to 33-3 become constant, thereby making it possible to adjust, based on the multiple delay times DE an electric conduction-switching timing for closing the injection magnetic valves 15-1 to 15-3 such that the pressure values sensed by the pressure sensors 33-1 to 33-3 can reach the preset upper limit values and remain constant thereafter.

It is inevitable that a delay occurs after electric conduction has been switched to ON or OFF, and before the valves start to mechanically operate. According to the present embodiment, the multiple delay times D1 that occur when the injection valve 15-1 to 15-3 is switched from the open state to the closed state are read, and the electric conduction-switching timing for closing the injection valve 15-1 to 15-3 is adjusted based on such delay times D1. In this way, it is possible to precisely control the pressure of the bag 3-1 to 3-3 at the time of injection, with respect to each pressurization unit 41-1 to 41-3.

The control unit 51 includes pressurization units 41-1 to 41-3, each of them includes: one of the open-air passages 13-1 to 13-3 as discharge passages for discharging the pressurized fluid that has been injected into the airbags 3-1 to 3-3; and one of the discharge magnetic valves 16-1 to 16-3 as discharge valves for opening and closing the open-air passages 13-1 to 13-3. The control unit 51, after the discharge magnetic valves 16-1 to 16-3 are opened to start discharging the pressurized fluids from the airbags 3-1 to 3-3, serves to close the discharge magnetic valves 16-1 to 16-3 through control regulation when the pressure value sensed by the pressure sensors 33-1 to 33-3 has reached a preset lower limit value with the pressurized fluid remaining in the airbags 3-1 to 3-3.

Here, by performing pressure control even at the time of discharge, as is the case with injecting the air into the airbags 3-1 to 3-3, in a manner such that the discharge will finish with a small amount of the pressurized air being retained in the airbags 3-1 to 3-3, such airbags 3-1 to 3-3 will undergo deformation less significantly such that the amount of the air consumed for the next injection can be reduced. Further, the loads of the air pumps 1-1 to 1-3 will become lighter such that a low power consumption can be achieved with regard to the air pumps 1-1 to 1-3.

The control unit 51 of the present embodiment is configured in the following manner. That is, after the control unit 51 switches the electric conduction to close the discharge magnetic valves 16-1 to 16-3, the control unit 51 will read multiple times the delay times D2 that occur until the pressure values sensed by the pressure sensors 33-1 to 33-3 have become constant, and then adjust, based on the multiple delay times D2, the electric conduction-switching timing for closing the discharge magnetic valves 16-1 to 16-3, in a way such that the pressure values sensed by the pressure sensors 33-1 to 33-3 become constant at the preset lower limit values.

In such case, the multiple delay times D2 due to the switching of the discharge magnetic valves 16-1 to 16-3 from open to close are read, and the electric conduction-switching timing for closing the discharge magnetic valves 16-1 to 16-3 is adjusted based on such delay times D2, thereby making it possible to precisely control the pressures of the airbags 3-1 to 3-3 at the time of discharge with respect to each of the pressurization unis 41-1 to 41-3.

Each of the diaphragm air pumps 1-1 to 1-3 used in this embodiment is the type of pump that has no rotation mechanism, but is capable of pushing out air through the diaphragm part repeatedly reciprocating in accordance with the frequency of the AC power. Further, the embodiment of the present invention includes the pump control devices 31-1 to 31-3 for supplying the phase-controlled AC power to the magnet coils EM of the air pumps 1-1 to 1-3.

Such configuration is established in each one of the pressurization unis 41-1 to 41-3. Particularly, the pump control devices 31-1 to 31-3 control the angle of flow (phase) every half cycle of the AC power to output the phase-controlled AC power to the magnet coils EM of the diaphragm air pumps 1-1 to 1-3, thus allowing the performances of the air pumps 1-1 to 1-3 to be easily changed. Moreover, as for the phase-control circuit installed in each of the pump control devices 31-1 to 31-3, a solid state relay (SSR) or the like may be used to configure such circuit in a simple manner, thus bringing about the merit of significantly simplifying the configuration of this circuit. In addition, since the diaphragm air pumps 1-1 to 1-3 are widely available in the market, not only the delivery period of the device can be shortened, but the cost thereof can also be reduced.

According to the present embodiment, there are employed a plurality of air pumps 1-1 to 1-3, and a distinctive pressure control method with respect to each of the air tanks 2-1 to 2-3, thereby reducing the volumes of the air tanks 2-1 to 2. Moreover, maximum working pressures of the air tanks 2-1 to 2-3 are small (around 50 kPa). For that reason, each of the air tanks 2-1 to 2-3 is preferably designed such that the product between the maximum pressure P (using MPa as its unit) of the gauge employed and the inner volume V (in terms of $m^3$) of the tank is not larger than 0.001 (i.e., $P \times V \leq 0.001$).

If the air tanks 2-1 to 2-3 are designed in this manner, such air tanks are not regarded as the (simple) container defined by a Japanese domestic law (item (xxvi) of Article 13 of the Order for Enforcement of the Industrial Safety and Health Act). For that reason, the air tanks 2-1 to 2-3 can be self-manufactured freely in terms of the shape thereof, thus making it possible to significantly reduce the space and cost of the ECP device 200.

Although described above is an embodiment of the present invention, this embodiment is merely presented as an example and thus shall not limit the scope of the invention. The embodiment presented can be carried in various other configurations. In short, such embodiment may be subjected to various kinds of omissions, displacements as well as modifications without departing from the scope of the invention.

For example, although the aforementioned embodiment uses the diaphragm air pumps 1-1 to 1-3, pumps of other types may also be employed. Further, although the ECP device 200 of the embodiment uses the pressurized air to stimulate a living body, there may also be used a fluid such as a gas or a liquid instead of air. Further, the relationship between ON/OFF state of the electric conduction for the valves and OPEN/CLOSED state of the valves may be in relation opposite to that described in the embodiments. Moreover, there may be employed any number of the pressurization units as long as the number is not smaller than two.

What is claimed:

1. A living body stimulator comprising:

a plurality of pressurization units that are independent from one another; and a control unit for individually and independently controlling an operation of each of said pressurization units, wherein each of said pressurization units includes:

a pump for generating a pressurized fluid;

a tank for retaining the pressurized fluid from said pump; and a pressurization bag worn by a living body, the pressurization bag pressurizing and thus stimulating the living body as the pressurized fluid is supplied from said tank to said pressurization bag, wherein each of said pressurization units further includes:

an injection valve for opening and closing a flow passage between said tank and said pressurization bag;

a bag pressure sensing unit provided on an outlet side of said injection valve;

a discharge passage for discharging the pressurized fluid that has been injected into said pressurization bag; and a discharge valve for opening and closing said discharge passage, and wherein said control unit is configured such that in each of said pressurization units, upon receiving an electrocardiographic waveform from the living body, said injection valve is closed and a pressure inside said pressurization bag is maintained when a pressure value sensed by said bag pressure sensing unit has reached a preset upper limit value after starting injecting the pressurized fluid from said tank by opening said injection valve, that said discharge valve is then closed to maintain the pressure inside said pressurization bag when the pressure value sensed by said bag pressure sensing unit has reached a preset lower limit value with the pressurized fluid remaining in said pressurization bag, after starting discharging the pressurized fluid from said pressurization bag by opening said discharge valve, and that when said injection valve is in a closed state, a pressure inside said tank is monitored by a tank pressure sensing unit providing a sensed output to the control unit to control said pump so as to maintain the pressure inside said tank within a preset range and then stop an operation of said pump when the pressure inside said tank has reached a preset value.

2. The living body stimulator according to claim 1, wherein said control unit sends a control signal to said injection valve upon receiving a sensed output from said bag pressure sensing unit, thus allowing said control unit to individually and independently control the pressure inside said pressurization bag.

3. The living body stimulator according to claim 1, wherein said control unit is configured to allow the pressure inside said pressurization bag to be individually set with respect to each of said pressurization units.

4. The living body stimulator according to claim 1, wherein said control unit is configured to allow the pressure inside said pressurization bag to be set every time a magnetic valve as said injection valve is opened to inject said pressurized fluid from said tank into said pressurization bag.

5. The living body stimulator according to claim 1, wherein said control unit is configured to individually and independently control the operation of said pump with respect to each of said pressurization units upon receiving the sensed output from said tank pressure sensing unit.

6. The living body stimulator according to claim 1, wherein said control unit is configured to read at least one or more delay times between when electric conduction is switched to close said injection valve and when the pressure value sensed by said bag pressure sensing unit becomes constant, thereby allowing an electric conduction-switching timing for closing said injection valve to be adjusted based on the at least one or more delay times such that the pressure value sensed by said bag pressure sensing unit remains constant after having reached the preset upper limit value.

7. The living body stimulator according to claim 1, wherein said control unit is configured to read at least one or more delay times between when electric conduction is switched to close said discharge valve and when the pressure value sensed by said bag pressure sensing unit becomes constant, thereby allowing an electric conduction-switching timing for closing said discharge valve to be adjusted based on the at least one or more delay times such that the pressure value sensed by said bag pressure sensing unit remains constant after having reached the preset lower limit value.

8. The living body stimulator according to claim 1, wherein said pump is a diaphragm pump for pushing out a fluid through a diaphragm part repeatedly reciprocating in accordance with a frequency of an alternating current (AC) power, and each of said pressurization units further includes a pump control device for supplying a phase-controlled AC power to said pump.

9. The living body stimulator according to claim 1, wherein said tank is designed to satisfy an inequality: $P \times V \leq 0.001$, where P represents a numerical value of a maximum gauge pressure (MPa) employed by the tank, and V represents a numerical value of an inner volume ($m^3$) of the tank.

10. The living body stimulator according to claim 1, wherein said control unit sends an identical valve-opening control signal to said injection valve and said discharge valve, said injection valve is switched from the closed state to an open state when said valve-opening control signal has switched from a first level to a second level, and said discharge valve is switched from a closed state to an open state when said valve-opening control signal has switched from the second level to the first level.

* * * * *